US007893375B2

(12) United States Patent
Chang et al.

(10) Patent No.: US 7,893,375 B2
(45) Date of Patent: Feb. 22, 2011

(54) NON-BACKLIGHTED ILLUMINATING KEYPAD

(75) Inventors: Yu-Chih Chang, Taoyuan (TW); Chang-Li Liu, Taoyuan (TW)

(73) Assignee: Ichia Technologies, Inc., Taoyuan (TW)

( * ) Notice: Subject to any disclaimer, the term of this patent is extended or adjusted under 35 U.S.C. 154(b) by 348 days.

(21) Appl. No.: 12/189,391

(22) Filed: Aug. 11, 2008

(65) Prior Publication Data

US 2009/0242368 A1 Oct. 1, 2009

(30) Foreign Application Priority Data

Apr. 1, 2008 (TW) ..... 97205563 U

(51) Int. Cl.
*H01H 9/00* (2006.01)

(52) U.S. Cl. ..... 200/314

(58) Field of Classification Search ..... 200/314, 200/512, 269, 448, 310
See application file for complete search history.

(56) References Cited

U.S. PATENT DOCUMENTS 7,053,799 B2 * 5/2006 Yu et al. ..... 341/31
2008/0037765 A1 2/2008 Finney et al.
2008/0128254 A1 * 6/2008 Jung et al. ..... 200/512
2008/0179173 A1 * 7/2008 Jung et al. ..... 200/314

FOREIGN PATENT DOCUMENTS

TW M322027 11/2007

* cited by examiner

*Primary Examiner*—Edwin A. Leon
(74) *Attorney, Agent, or Firm*—Chun-Ming Shih; HDLS IPR Services

(57) ABSTRACT

A non-backlighted illuminating keypad includes a keypad panel, a light gathering layer, an electronic ink layer, a first elastic layer and a switch board. The keypad panel includes a carrier and a plurality of keycaps arranged on the carrier. The light gathering layer is arranged on a bottom surface of the keypad panel and located corresponding to the keycaps. The electronic ink layer is arranged on a bottom surface of the light gathering layer. The first elastic layer is arranged on a bottom surface of the electronic ink layer and comprises a plurality of protrusion portions respectively corresponding to the keycaps. The switch board is arranged below the elastic layer.

12 Claims, 15 Drawing Sheets

NON-BACKLIGHTED ILLUMINATING KEYPAD

BACKGROUND OF THE INVENTION

1. Field of the Invention

The present invention relates to a keypad, in particular to a non-backlighted illuminating keypad.

2. Description of Related Art

Backlight module is extensively used as a light source in liquid crystal display, advertising apparatus and portable electronic devices. In a portable electronic device such as cellular phone or personal digital assistant (PDA), the light source is often arranged behind a keypad panel to provide light penetrated through the keypad panel to illuminate the numerals, characters or symbols on the keypad panel.

Conventional backlight module usually includes a light guide plate and a light emitting device (LED) used to emit light into the light guide plate. Light propagates in the light guide plate and diffuses from a surface of light guide plate to keys of the keypad panel, such that users can clearly identify the numerals, character or symbol printed on the surfaces of keys.

Electronic ink techniques are already employed to electronic display apparatus to show information. The electronic ink material includes a plurality of microcapsules each contains both white and black particles in a microcapsule wall. The electronic ink microcapsules are printed on an electrode substrate, which can generate electrical field to control the behaviors of the white and black particles in the microcapsules. By controlling the behaviors of those colored particles in each microcapsule, it is possible to get macroscopic images from the microcapsules printed on the electrode substrate.

Therefore, the electronic ink techniques seem promising to use in a keypad, thus replacing the numerals, characters and symbols printed on the surfaces of keys. However, since the electronic ink material is not transparent, it cannot employ conventional backlight module for illuminating the electronic ink material to display the numerals, characters or symbols and requires an appropriate accompanying light-source module to compose a practical keypad.

SUMMARY OF THE INVENTION

The present invention is to provide a non-backlighted illuminating keypad, capable of displaying numerals, characters and symbols by controlling the behaviors of colored particles in electronic ink microcapsules. Besides, a light gathering layer is formed above an electronic ink layer to gather light to illuminate the electronic ink layer. Therefore, images formed by electronic ink layer can be clearly viewed by users.

In order to achieve the aforementioned purpose, the present invention provides a non-backlighted illuminating keypad, includes a keypad panel, a light gathering layer, an electronic ink layer, a first elastic layer and a switch board. The keypad panel includes a carrier and a plurality of keycaps arranged on the carrier. The light gathering layer is arranged on a bottom surface of the keypad panel and located corresponding to the keycaps. The electronic ink layer is arranged on a bottom surface of the light gathering layer. The first elastic layer is arranged on a bottom surface of the electronic ink layer and comprises a plurality of protrusion portions respectively corresponding to the keycaps. The switch board is arranged below the elastic layer.

BRIEF DESCRIPTION OF THE DRAWINGS

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

A detailed description of the present invention will be made with reference to the accompanying drawings.

Figure 1:
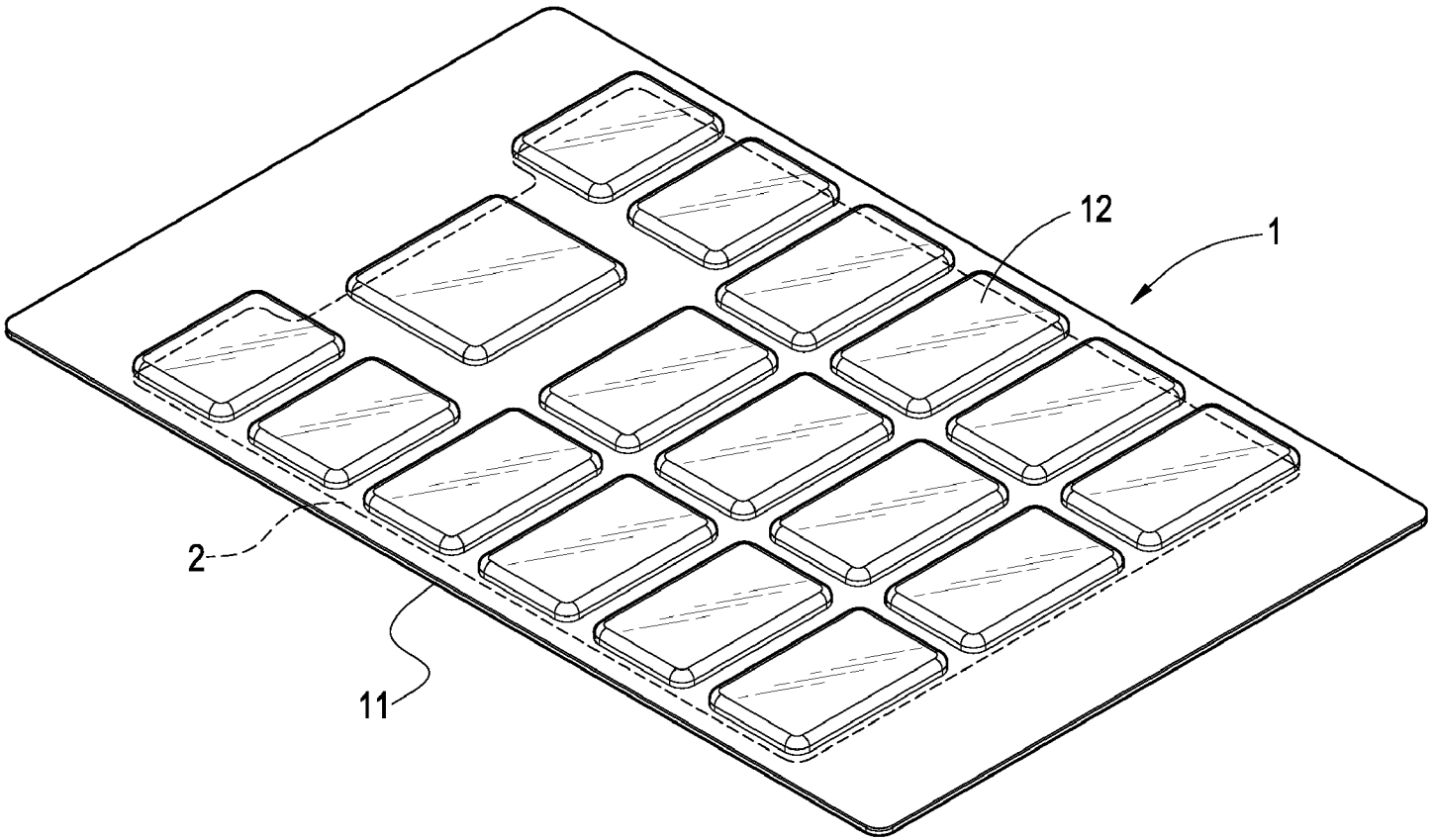
FIG. 1 is a perspective view of the keypad of the present invention.
Figure 2:
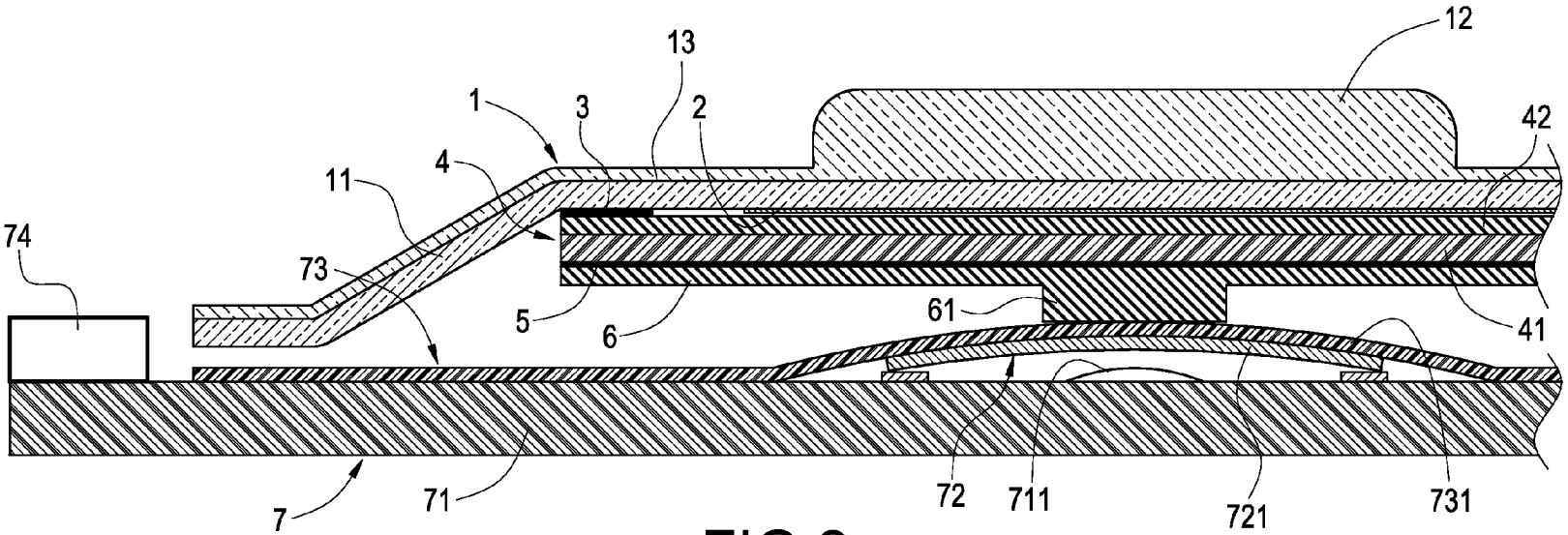
FIG. 2 is a cross-sectional view of the keypad in FIG. 1.

As shown in FIGS. 1 and 2, the keypad according to a preferred embodiment of the present invention includes a keypad panel 1, a light gathering layer 2, a first adhesion layer 3, an electronic ink layer 4, a second adhesion layer 5, a first elastic layer 6 and a switch board 7.

The keypad panel 1 includes a carrier 11 and a keycap layer 13 with a plurality of keycaps 12 arranged on a top surface of the carrier 11. The carrier 11 is a transparent plastic thin film. The keycaps 12 are made of transparent ultraviolet-curing resin.

The light gathering layer 2 is arranged on the bottom surface of the carrier 11 and is located corresponding to the keycaps 12. The light gathering layer 2 is made of light gathering ink material.

The first adhesion layer 3 is also arranged on the bottom surface of the carrier 11 where the light gathering layer 2 is not arranged. The first adhesion layer 3 may be adhesive agent or double-sided adhesive tape.

The electronic ink layer 4 is attached on the bottom surface of the carrier 11 by the first adhesion layer 3 and is located below the light gathering layer 2. The electronic ink layer 4 includes an electrode substrate 41 and an electronic ink material 42 printed on the top surface of the electrode substrate 41. The electrode substrate 41 includes a plurality of electrode traces (not shown) having patterns such as numerals, characters and symbols. The electronic ink material 42 includes a plurality of microcapsules (not shown) each having both white and black particles inside. After the electrode traces are electrically charged, the behaviors of particles inside the microcapsules will changed, and then the desired images are formed by the microcapsules of the electronic ink material 42. Since the electronic ink layer 4 is well known by those of ordinary skill in the art, the details thereof will not be described herein.

The second adhesion layer 5 is arranged on the bottom surface of the electrode substrate 41. The second adhesion layer 5 may be adhesive agent or double-sided adhesive tape.

The first elastic layer 6 is attached on the bottom surface of the electrode substrate 41 of the electronic ink layer 4 by the second adhesion layer 5. The first elastic layer 6 includes a plurality of protrusion portions 61 respectively corresponding to the keycaps 12.

Figure 3:
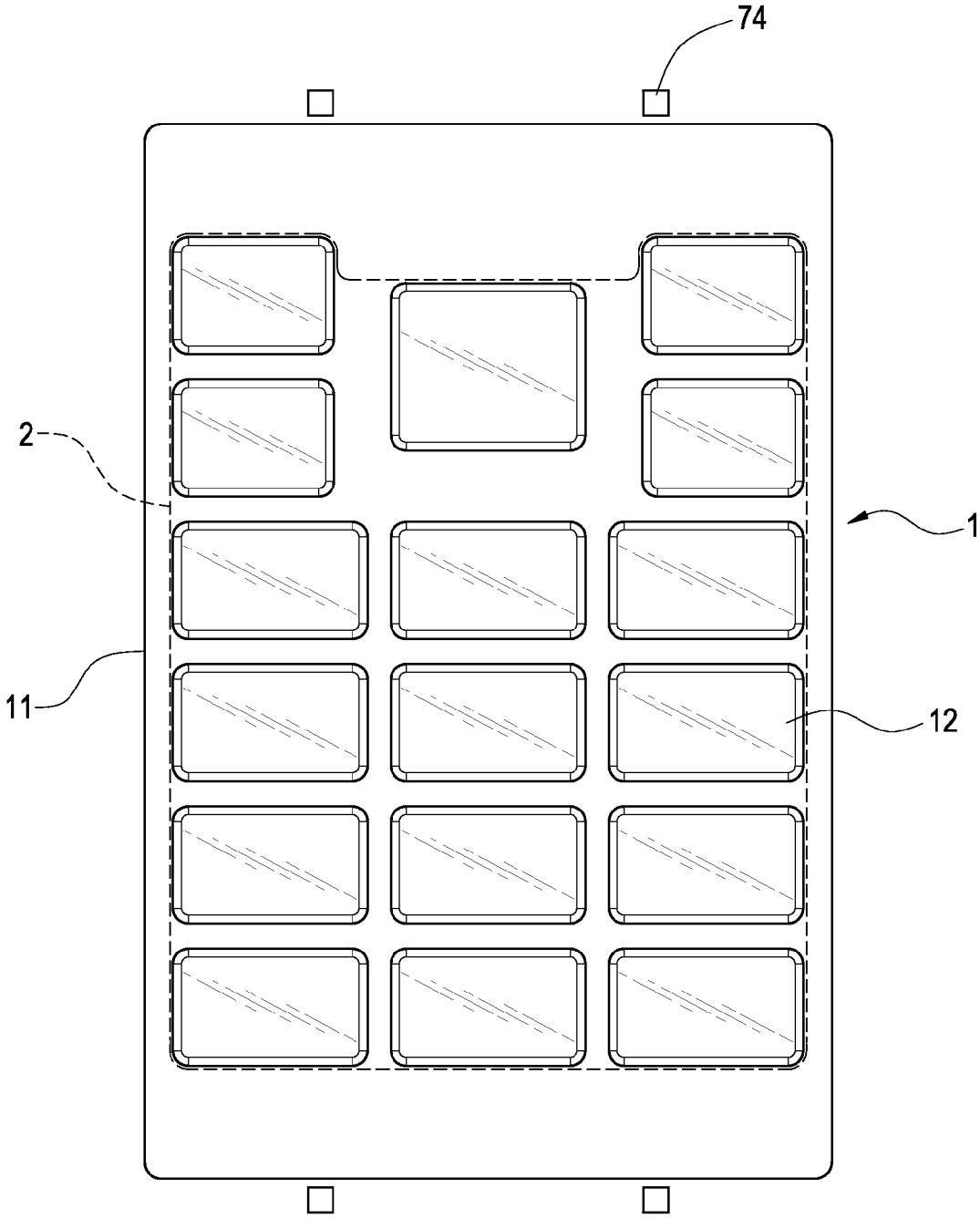
FIG. 3 is a top view of the keypad in FIG. 1.

The switch board 7 is arranged below the first elastic layer 6. The switch board 7 includes a printed circuit board 71 and a second elastic layer 72 arranged on the printed circuit board 71. The second elastic layer 72 includes a plurality of metal domes 721. The printed circuit board 71 includes a plurality of electrical contacts 711 corresponding to the metal domes 721. The switch board 7 also includes a thin film 73 covered on the printed circuit board 71 and the second elastic layer 72, and a light source 74 electrically connected to the printed circuit board 71. The thin film 73 includes a plurality of convex portions 731 corresponding to the protrusion portions 61 of the first elastic layer 6. As FIG. 3 shows, the light source 74 correspondingly located at a lateral side of the carrier 11. In the present embodiment, the light source 74 is a light emitting diode.

Figure 4:
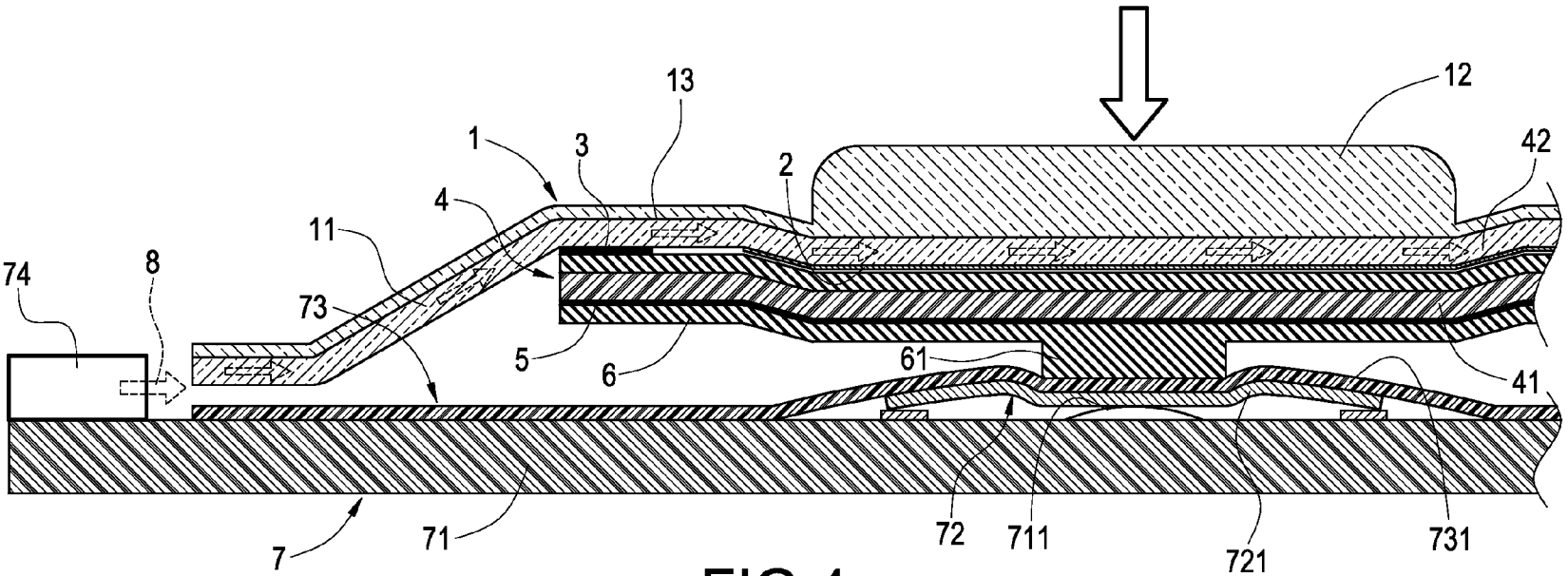
FIG. 4 is a cross-sectional view of the keypad in FIG. 1.
Figure 5:
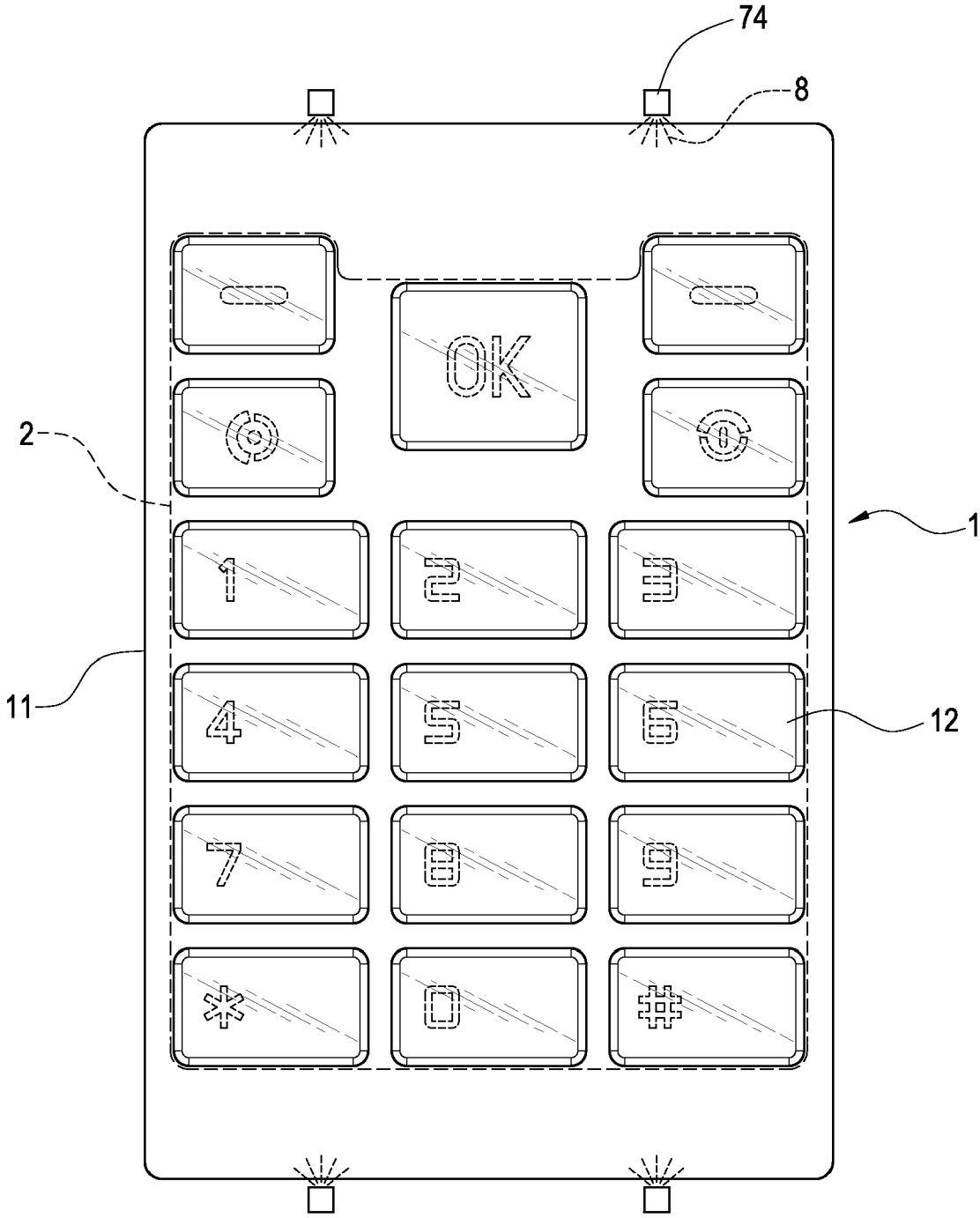
FIG. 5 is a top view of the keypad in FIG. 1.
Figure 6A:
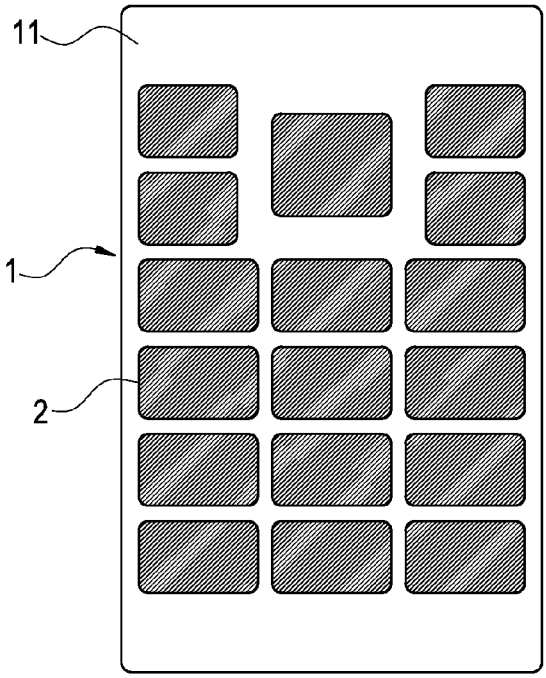
FIGS. 6(*a*) to 6(*e*) show different arrangements of a light gathering layer on a bottom surface of a carrier of the present invention.
Figure 6B:
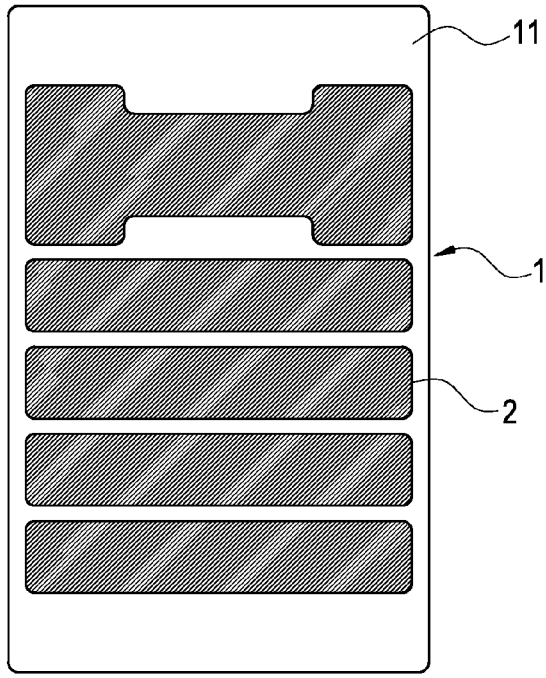
Figure 6C:
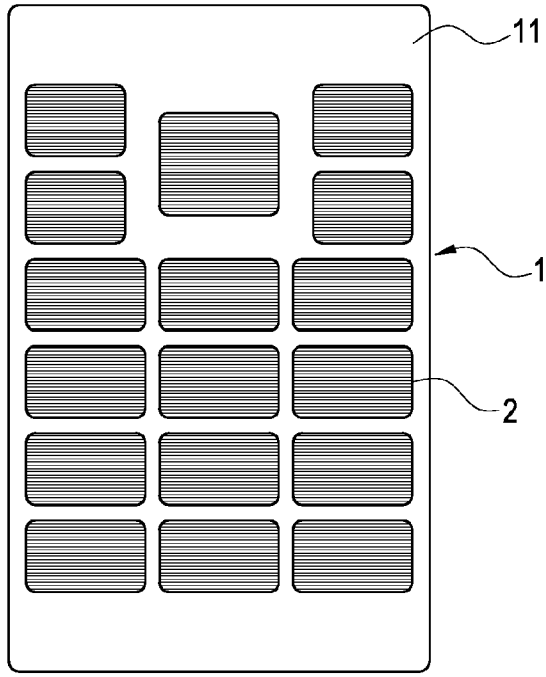
Figure 6D:
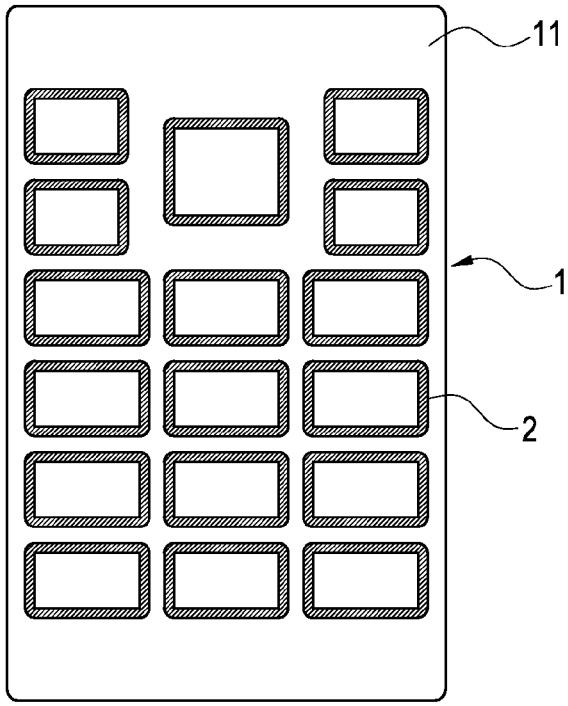
Figure 6E:
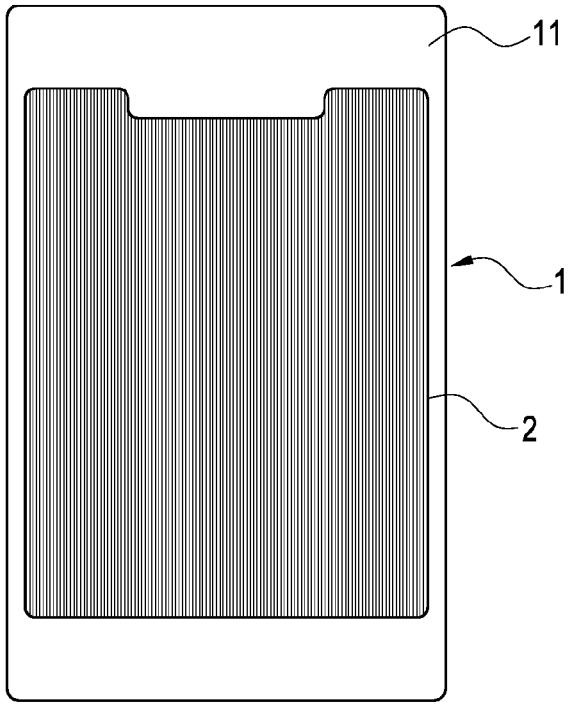
Figure 7:
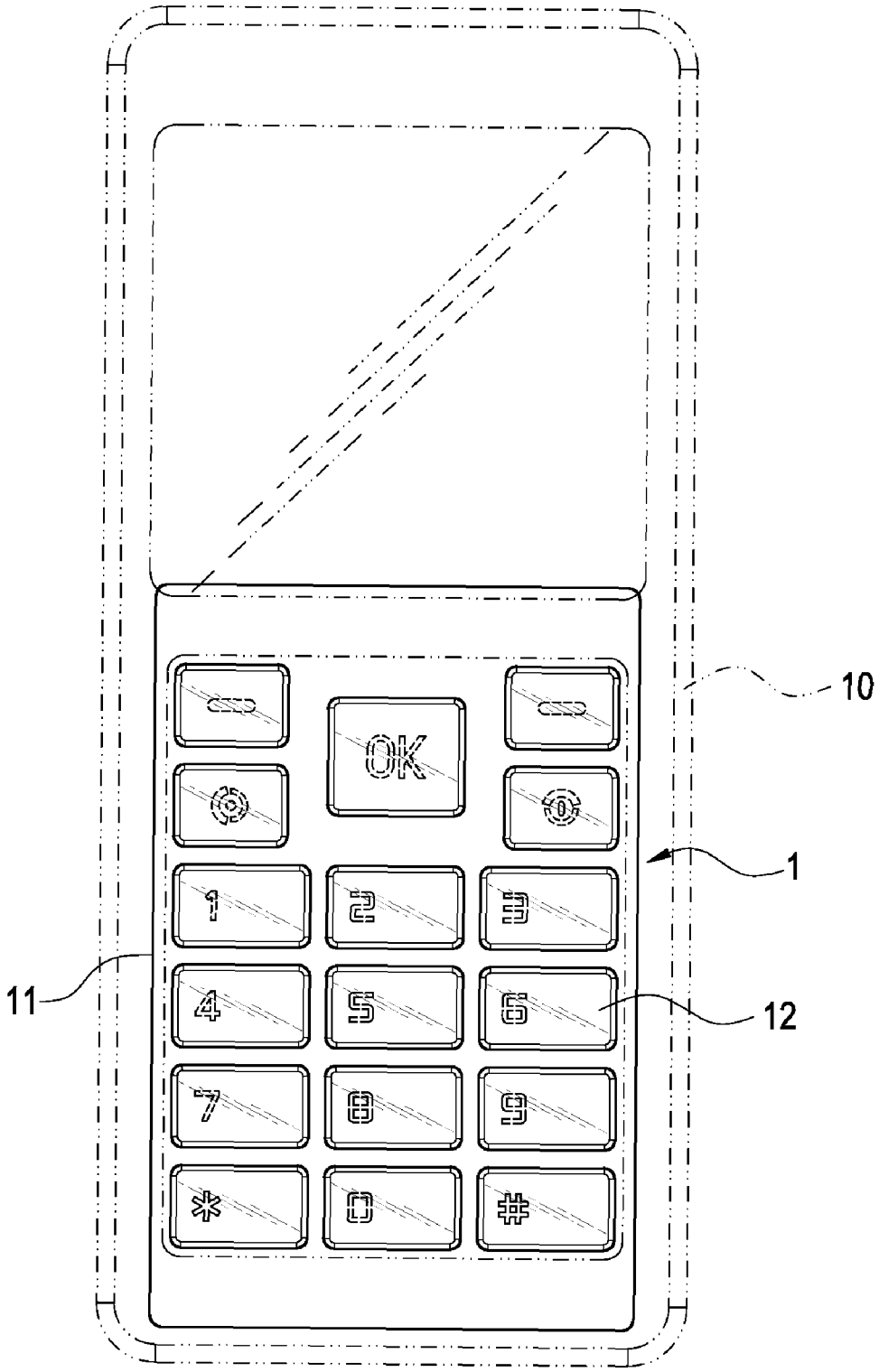
FIG. 7 is a schematic view showing the present invention being used in a mobile phone.
Figure 8:
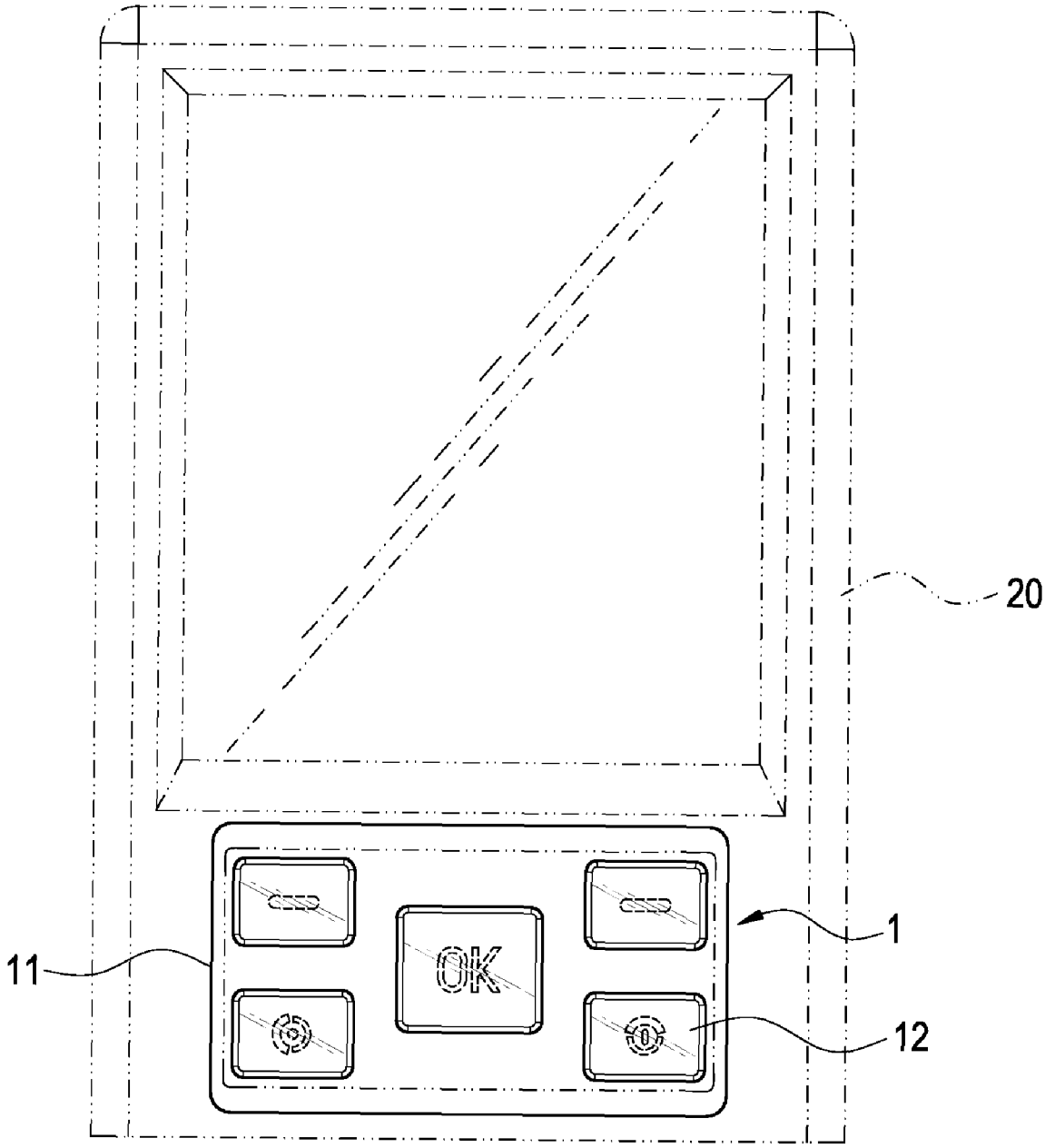
FIG. 8 is a schematic view showing the present invention being used in a personal digital assistant.
Figure 9:
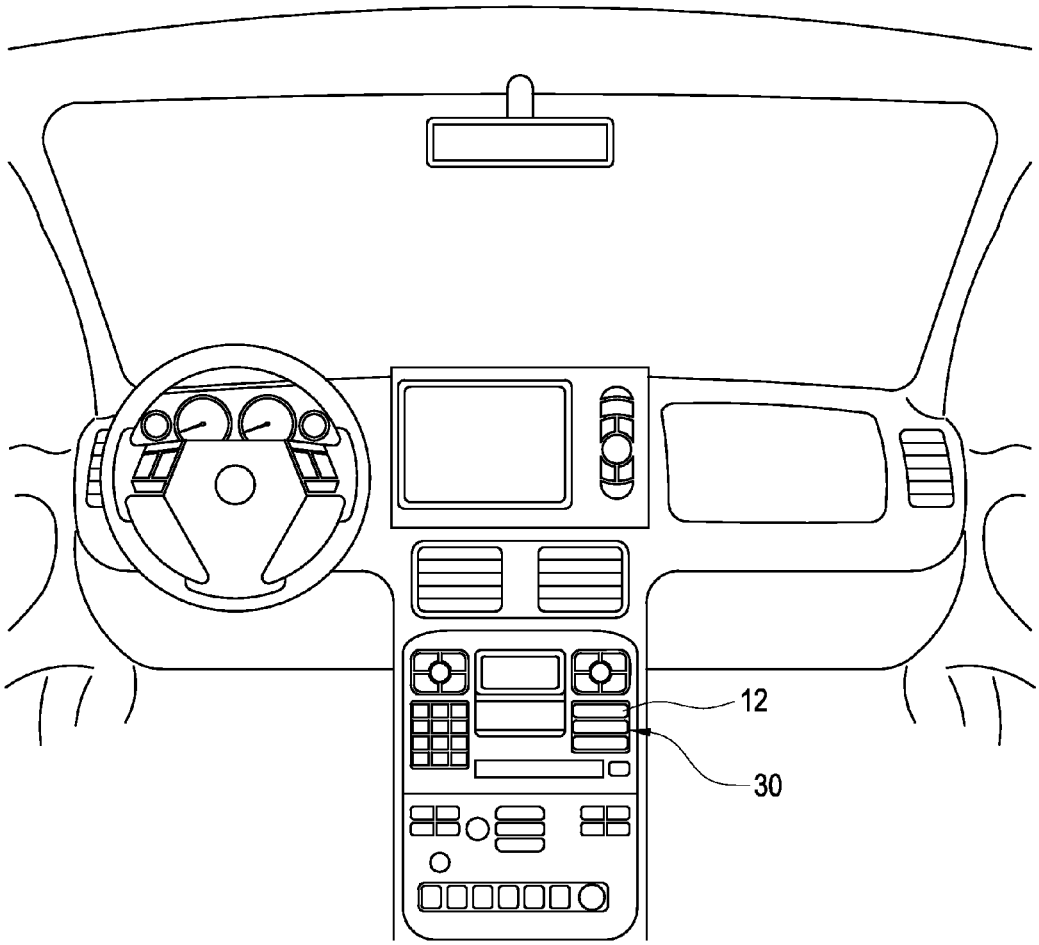
FIG. 9 is a schematic view showing the present invention being used in a car audio system.
Figure 10:
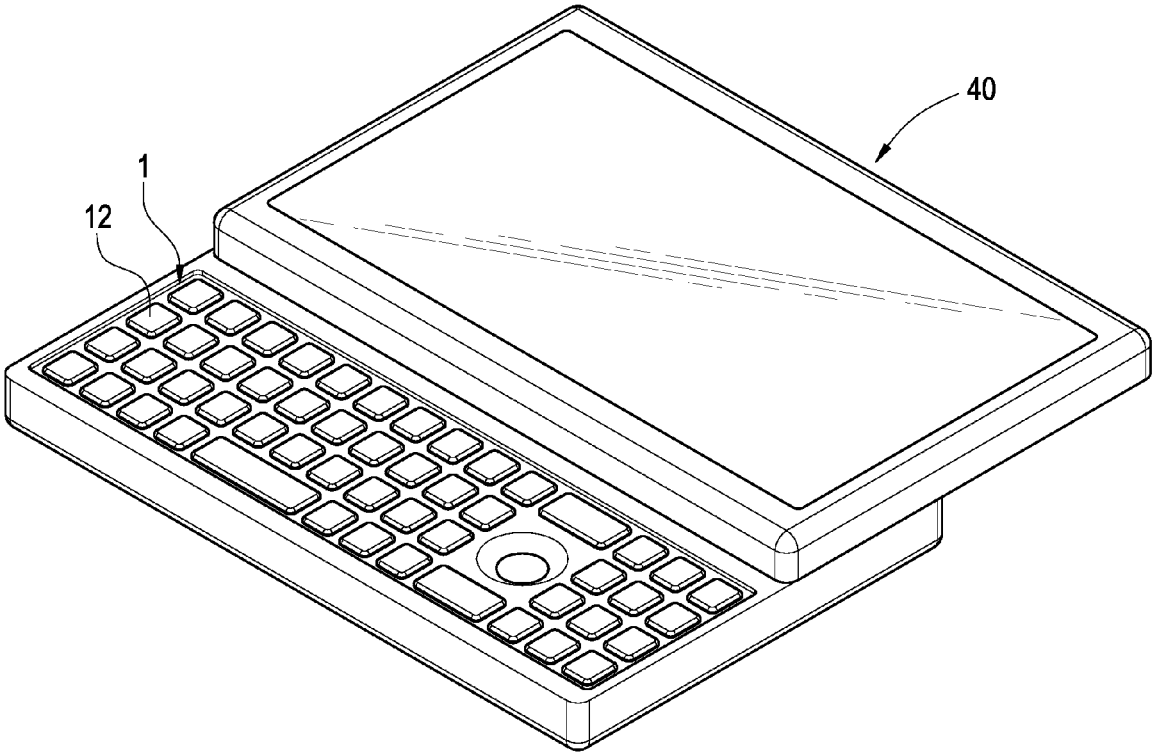
FIG. 10 is a schematic view showing the present invention being used in an ultra portable mobile computer.
Figure 11:
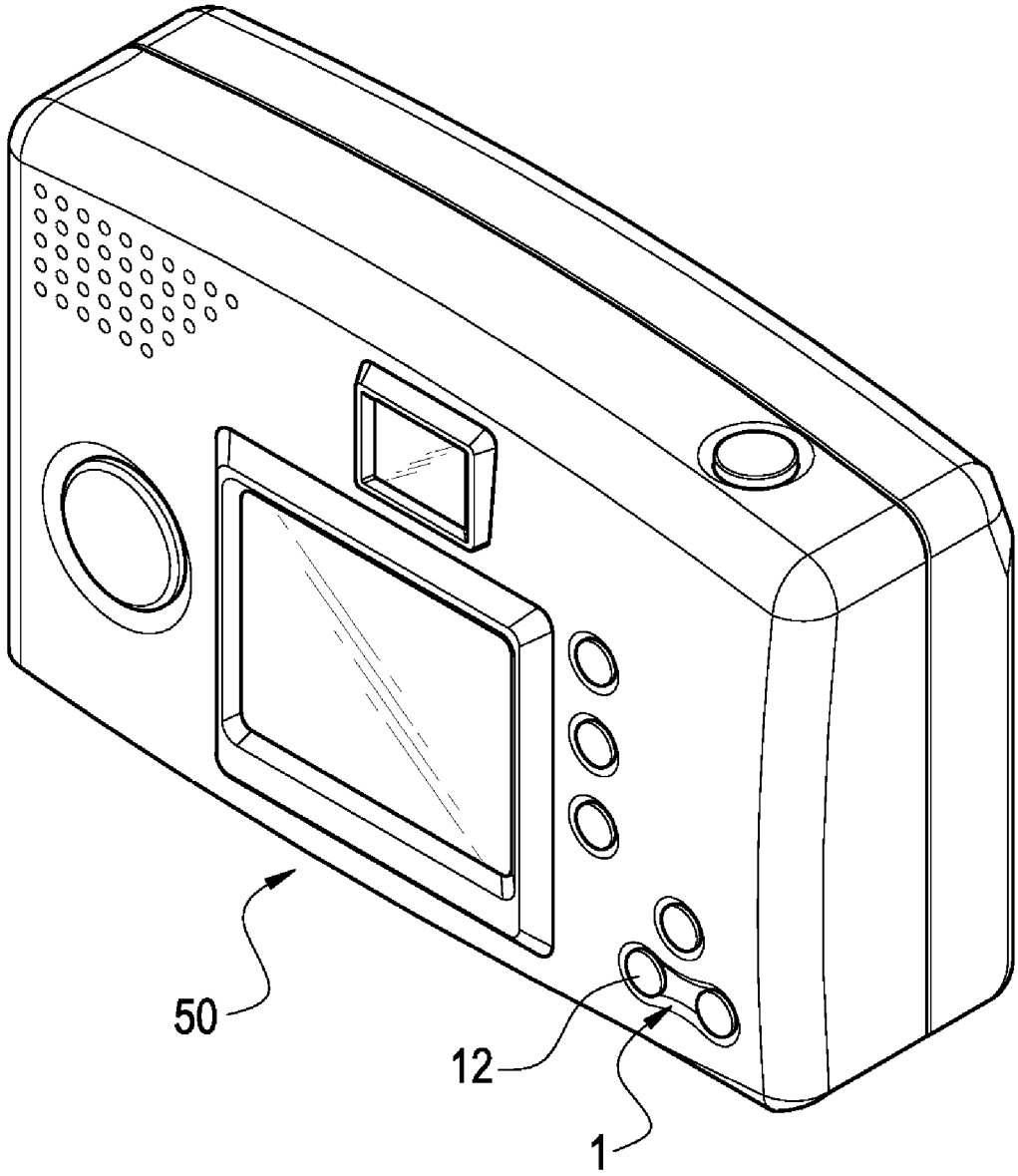
FIG. 11 is a schematic view showing the present invention being used in a camera.
Figure 12:
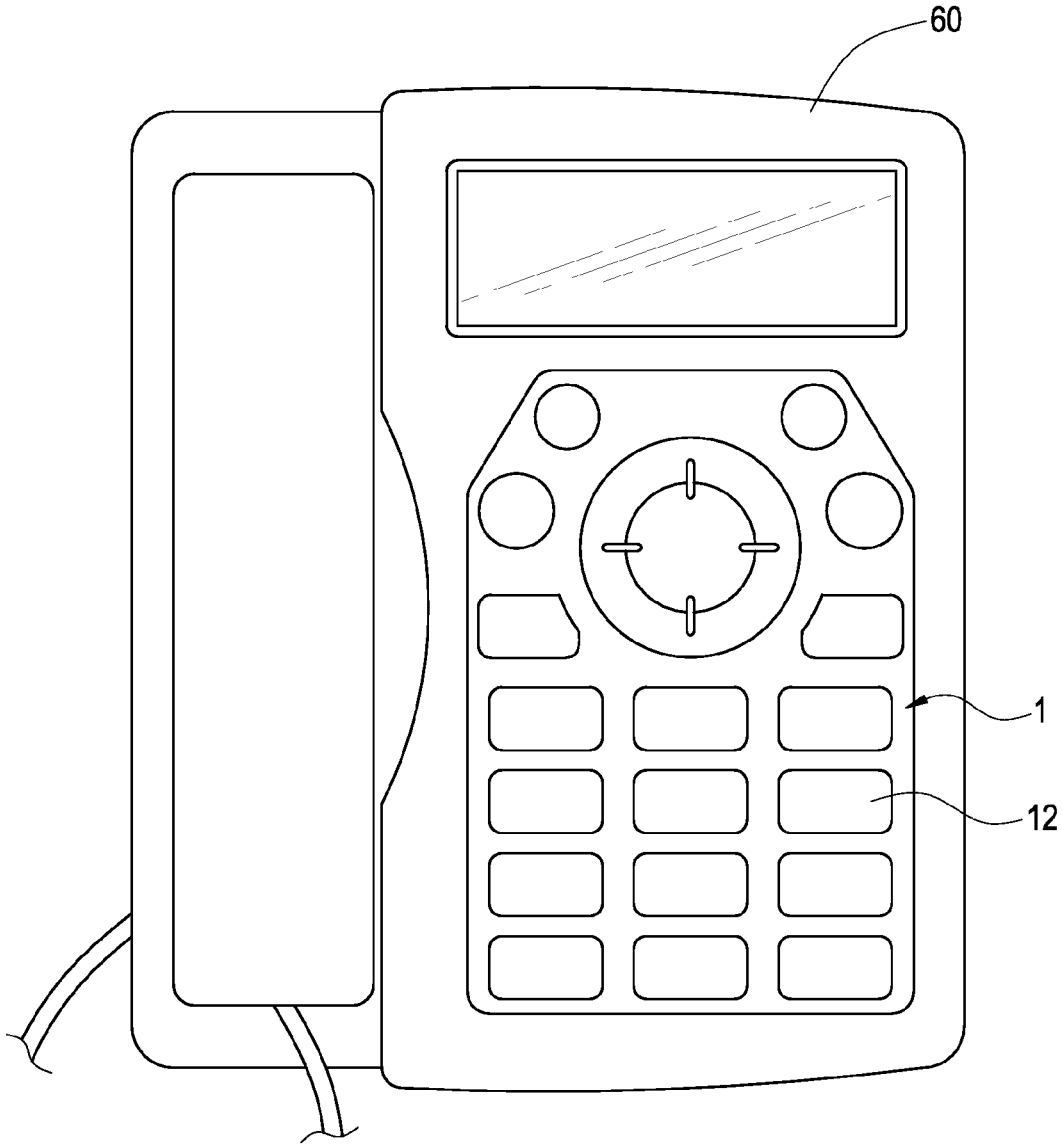
FIG. 12 is a schematic view showing the present invention being used in a desktop telephone.

Refer to FIGS. 4 and 5, when the keycap 12 is pressed by external force, the keycap 12 will downwardly press the light gathering layer 2, the electronic ink layer 4 and the first elastic layer 6, and then the protrusion portion 61 of the first elastic layer 6 will press the second elastic layer 72 to contact with the electrical contact 711 of the printed circuit board 71, and then a connecting signal will be generated for output.

When the light source 74 on the printed circuit board 71 is lighted on, light 8 emitted from the light source 74 enter the carrier 11 from the lateral side thereof. The light 8 is gathered around the light gathering layer 2 to illuminate the adjacent electronic ink material 42. At the same time, the electrode substrate 41 of the electronic ink layer 4 is electrically charged, the behaviors of particles inside the microcapsules are changed, and then the images of numerals, characters and symbols are formed by the electronic ink material 42. Therefore, users can clearly identify the pattern of each key and precisely press the right keycap.

Refer to FIGS. 6(*a*) to 6(*e*), they show five different arrangements of the light gathering layer of the present invention. The light gathering layer 2 in FIG. 6(*a*) is arranged according to locations of the keycaps. The light gathering layer 2 in FIG. 6(*b*) is arranged according to locations of another kind of stripe-like keycaps. Both light gathering layers 2 in FIGS. 6(*a*) and 6(*b*) have an obliquely line pattern. The light gathering layer 2 in FIG. 6(*c*) has a horizontal line pattern. The light gathering layer 2 in FIG. 6(*d*) printed along outlines of each keycap. The light gathering layer 2 in FIG. 6(*e*) has only one region covered all the keycaps and has vertical line pattern.

As FIGS. 7 to 12 show, the non-backlighted illuminating keypad of to the present invention can be respectively applied to a mobile phone 10, a personal digital assistant (PDA) 20, a car audio system 30, an ultra portable mobile computer (UMPC) 40, and a camera 50, a desktop telephone 60.

Figure 13:
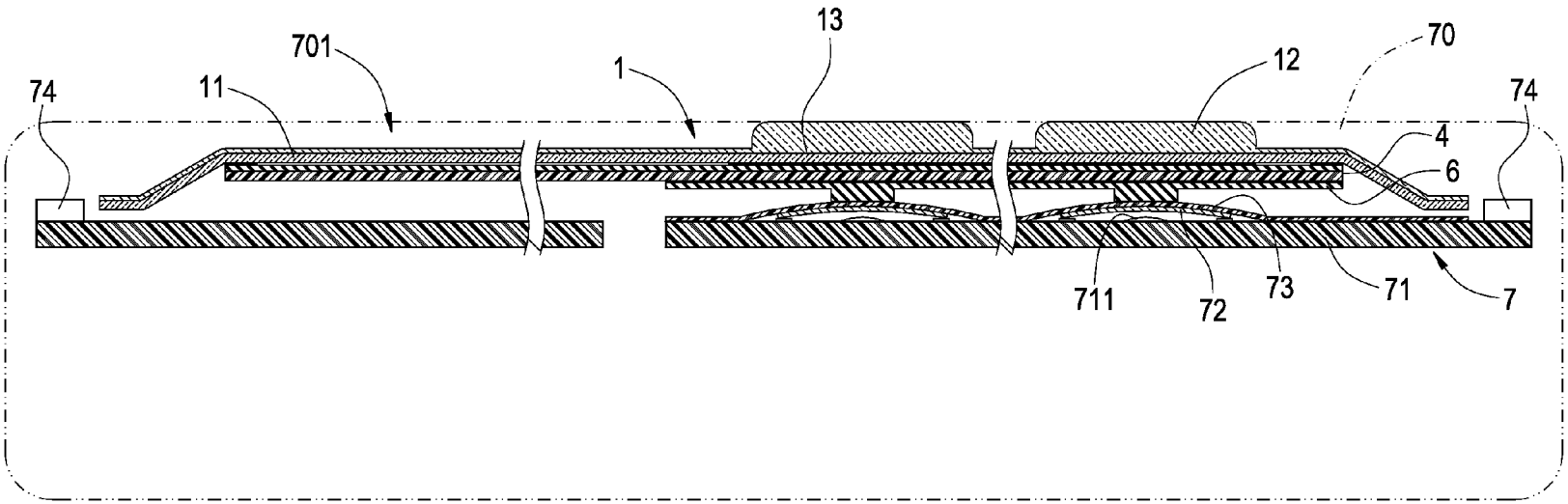
FIG. 13 is a cross-sectional view of another embodiment of the keypad of the present invention.
Figure 14:
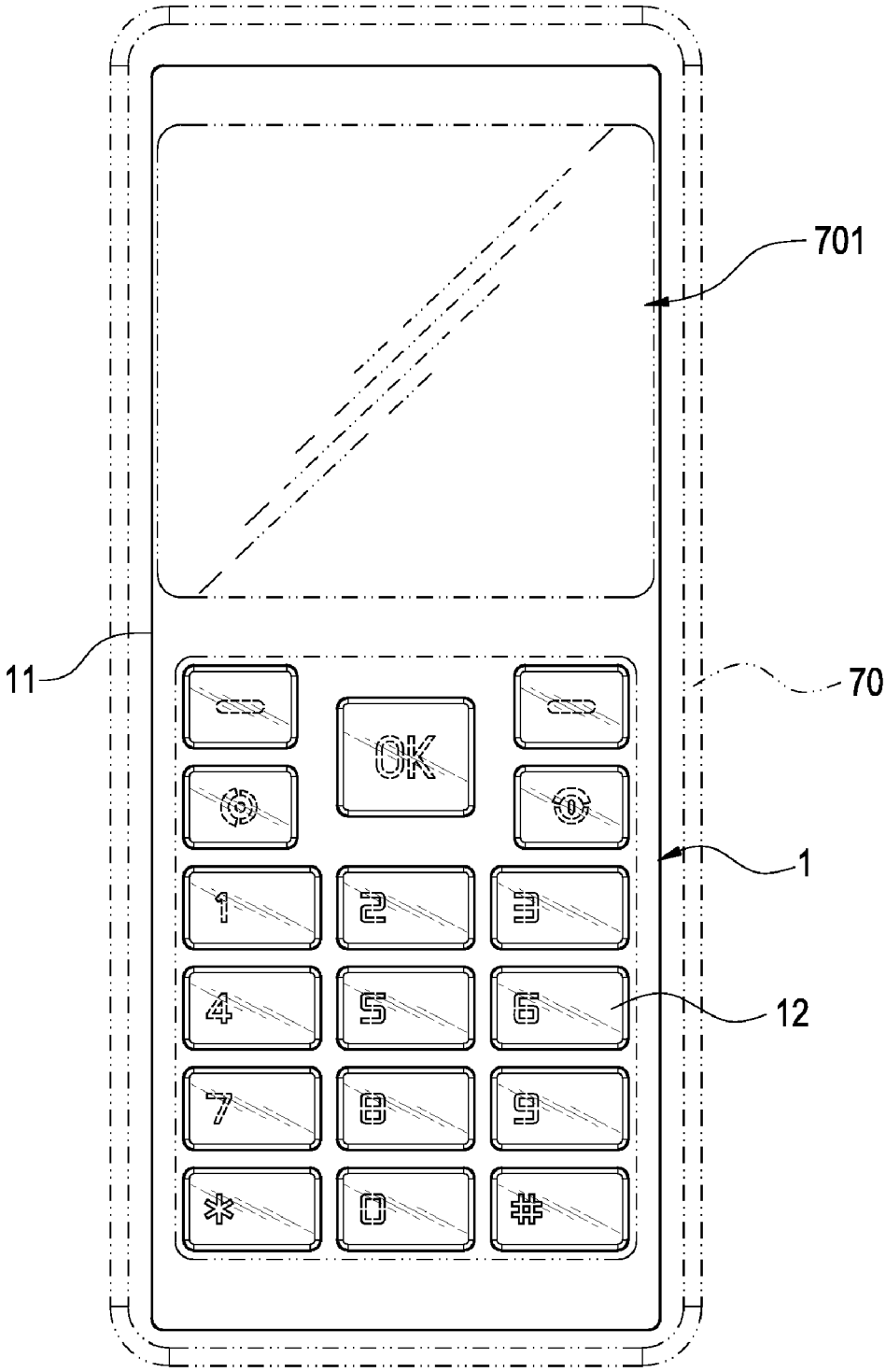
FIG. 14 is a top view of the keypad in FIG. 13.

Refer to FIGS. 13 and 14, in another embodiment of the keypad 1 of the present invention, the electronic ink layer 4 further extend to the display region 701 of portable electronic apparatus 70 to further play a role of display module to show information of the numerals, characters or symbols.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A non-backlighted illuminating keypad, comprising:

a keypad panel comprising a carrier and a keycap layer with a plurality of keycaps formed on a top surface of the carrier;

a light gathering layer made of light gathering ink material, printed directly on a bottom surface of the carrier and located corresponding to the keycaps;

an electronic ink layer arranged on a bottom surface of the light gathering layer;

a first elastic layer arranged on a bottom surface of the electronic ink layer and comprising a plurality of protrusion portions respectively corresponding to the keycaps; and a switch board arranged below the first elastic layer.

2. The non-backlighted illuminating keypad according to claim 1, wherein the carrier is a plastic thin film.

3. The non-backlighted illuminating keypad according to claim 1, wherein the keycaps are made of ultraviolet-curing resin.

4. The non-backlighted illuminating keypad according to claim 1, wherein the electronic ink layer comprises an electrode substrate and an electronic ink material printed on the top surface of the electrode substrate.

5. The non-backlighted illuminating keypad according to claim 1, further comprising a first adhesion layer for attaching the electronic ink layer to the carrier.

6. The non-backlighted illuminating keypad according to claim 5, wherein the first adhesion layer is adhesive agent or double-sided adhesive tape.

7. The non-backlighted illuminating keypad according to claim 1, further comprising a second adhesion layer for attaching the first elastic layer to the electronic ink layer.

8. The non-backlighted illuminating keypad according to claim 7, wherein the second adhesion layer is adhesive agent or double-sided adhesive tape.

9. The non-backlighted illuminating keypad according to claim 1, wherein the switch board comprises a printed circuit board, a second elastic layer arranged on the printed circuit board and a thin film covered on the printed circuit board and the second elastic layer.

10. The non-backlighted illuminating keypad according to claim 9, wherein the second elastic layer comprises a plurality of metal domes.

11. The non-backlighted illuminating keypad according to claim 9, wherein the switch board further comprises a light source electrically connected to the printed circuit board and correspondingly located at a lateral side of the carrier.

12. The non-backlighted illuminating keypad according to claim 11, wherein the light source is a light emitting diode.

* * * * *